US006543977B2

(12) United States Patent
Sander et al.

(10) Patent No.: US 6,543,977 B2
(45) Date of Patent: Apr. 8, 2003

(54) CONCRETE ANCHOR BOLT

(75) Inventors: Bernhard Sander, Feldkirch (AT); Joachim Günther, Nüziders (AT); Marcel John, Mels (CH); Michael Siemers, Feldkirch (AT); Pietro Bianchi, Feldkirch (AT); Erich Wisser, Bregenz (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/055,656

(22) Filed: Jan. 23, 2002

(65) Prior Publication Data

US 2002/0098055 A1 Jul. 25, 2002

(30) Foreign Application Priority Data

Jan. 25, 2001 (DE) ..... 101 03 231

(51) Int. Cl.[7] ..... F16B 1/00; F16B 21/00

(52) U.S. Cl. ..... 411/82.1; 411/339; 411/479; 411/930; 52/703; 52/704

(58) Field of Search ..... 411/82, 82.1, 338, 411/339, 479, 930; 52/698, 703, 704

(56) References Cited

U.S. PATENT DOCUMENTS 4,313,696 A * 2/1982 Horten ..... 411/479
4,472,087 A 9/1984 Elders
4,712,957 A * 12/1987 Edwards et al. ..... 411/82.1
4,993,900 A * 2/1991 Hugel et al. ..... 411/82.1

* cited by examiner

*Primary Examiner*—Neill Wilson
(74) *Attorney, Agent, or Firm*—Sidley Austin Brown & Wood, LLP

(57) ABSTRACT

A concrete anchor bolt formed of an axially extending fixing member (1) having a first axially extending section (5) fixable in a tapped blind borehole (3) in a first solid body (4) secured by a temporarily fluid fixing agent (2) and an axially protruding second axially extending section (7) embeddable in a subsequently settable second solid body (6), wherein a conically shaped section sleeve (8) is present on the second section (7).

10 Claims, 2 Drawing Sheets

CONCRETE ANCHOR BOLT

BACKGROUND OF THE INVENTION

The invention relates to an concrete anchor bolt for high-tensile interconnection of two solid bodies in a concrete-to-concrete bond.

In a concrete-to-concrete bond the concrete anchor bolt, together with its fixing member, is installed using a temporarily fluid, settable fixing agent, such as a reaction resin mortar, in a blind tapped borehole in a first solid body, such as set concrete, and with a radially projecting connecting element embedded in the first body, and using a subsequently setting, second solid body, such as fresh concrete.

At the utilization site, prefabricated angled or conically ended closed reinforcement iron pieces as well as threaded plates together with threaded bars are conventionally used on site. The concrete anchor bolts are not optimally designed with respect to their resistance to extraction of the connecting element from the fresh concrete or the tensile or tractional force transmission in same as well as the tensile rigidity.

As disclosed in WO99/61716, a conical capping member screwed onto a threaded rod is embedded in fresh concrete, whereby the conical capping member readily ends flush with the surface of the fresh concrete and only bonds with the fresh concrete with respect to the poorly adhering conical surface. The conical capping element forms a double radial angle at an axial half-angle of 15° along its axial length. The conical capping element is not optimized for force transmission but serves as a negative mold that can be easily removed with respect to the surface of the fresh concrete.

CH684648A5 discloses threaded sleeves comprised of plastic and having circumferentially distributed conical ribs having an axial half-angle of 45° and double radial angle along their axial length embedded in fresh concrete. Only minimal tensile or tractional loads can be applied in the case of plastic threaded sleeves.

Further, DE2355799 discloses wavelike tubular elements embedded in fresh concrete and combined with other structural components by threading.

SUMMARY OF THE INVENTION

The object of the present invention is a technically simplified embodiment of a concrete anchor bolt having an optimized geometry with respect to tensile force transmission and tensile rigidity.

Essentially, a concrete anchor bolt comprises an axially extending, connecting or fixing member that can be fixed in a blind hole in a first solid body using a temporarily fluid, settable fixing agent and a radially projecting conically shaped section that is embedded at a later point in time in a setting second solid body and forms a part of the fixing member.

The conically shaped section is oriented rotationally symmetrically diagonally to the direction of loading of the conically shaped section and is made extremely rigid by the concrete filling and results, at the time of tensile or tractional loading of the anchor bolt, in loading favorable to concrete within the conical region and thus in force transmission adapted to the material properties of concrete.

Advantageously, according to pre-testing, the axial half-angle is in the range of 20° to 40°, in the simulated ideal situation is 30°, which results in an optimal force transmission in the material concrete.

The radial angle, determined as the relation of the end diameter the axial length of the conical sleeve, advantageously is in the range of 2, 5 to 5, whereby the axial tensile or tractional loading derived with respect to the fixing section of the anchor bolt is completely transformable into compressive loading of the normally oriented conical region without locally exceeding permissible compressive strength limits.

The conically shaped section is advantageously formed hollow with essentially uniform wall thickness, and can be manufactured in a technically simple manner and thus economically by punching and shaping processes in large numbers and further advantageously produced from sheet iron or iron tube ends of several mm thickness.

The conically shaped section is advantageously produced as a separate structural member piece for material-bonding by welding or for axially form-locked connection by screw-on or by rotational engagement or locking using a special axial aperture designed as a connector and/or guide established at the smaller surface as a connector and/or guide arranged on a special residual anchor bolt, whereby a simple combination of system components addressing the requirement can be formed at the utilization site.

The special axial opening of the conical sleeve is advantageously designed for connection to an axially extending region of the anchor bolt and provides an axial projection of the residual anchor bolt over the overall coverage surface of the conical sleeve, so that when hammering the anchor bolt into the tapped blind borehole the impact is not made directly on the conical sleeve and avoids damaging it.

An advantageous alternative is created if the conically shaped section is prefabricated as a unit with the anchor bolt, whereby the predetermined fracture points limiting force transmission at material-bonding or form-locking connection points are provided, which avoids the combination of a separate conically shaped section with the residual anchor bolt at the utilization site.

The conical sleeve is advantageously made as a radially expandable terminal section of a tubular section forming the anchor bolt, whereby a smooth transmission of force into the wall of the tube is possible without scoring or notching that limits force transmission.

BRIEF DESCRIPTION OF THE DRAWING

The invention is more completely described read together with an advantageous exemplary embodiments, wherein.

DESCRIPTION OF THE EMBODIMENTS

Figure 1:
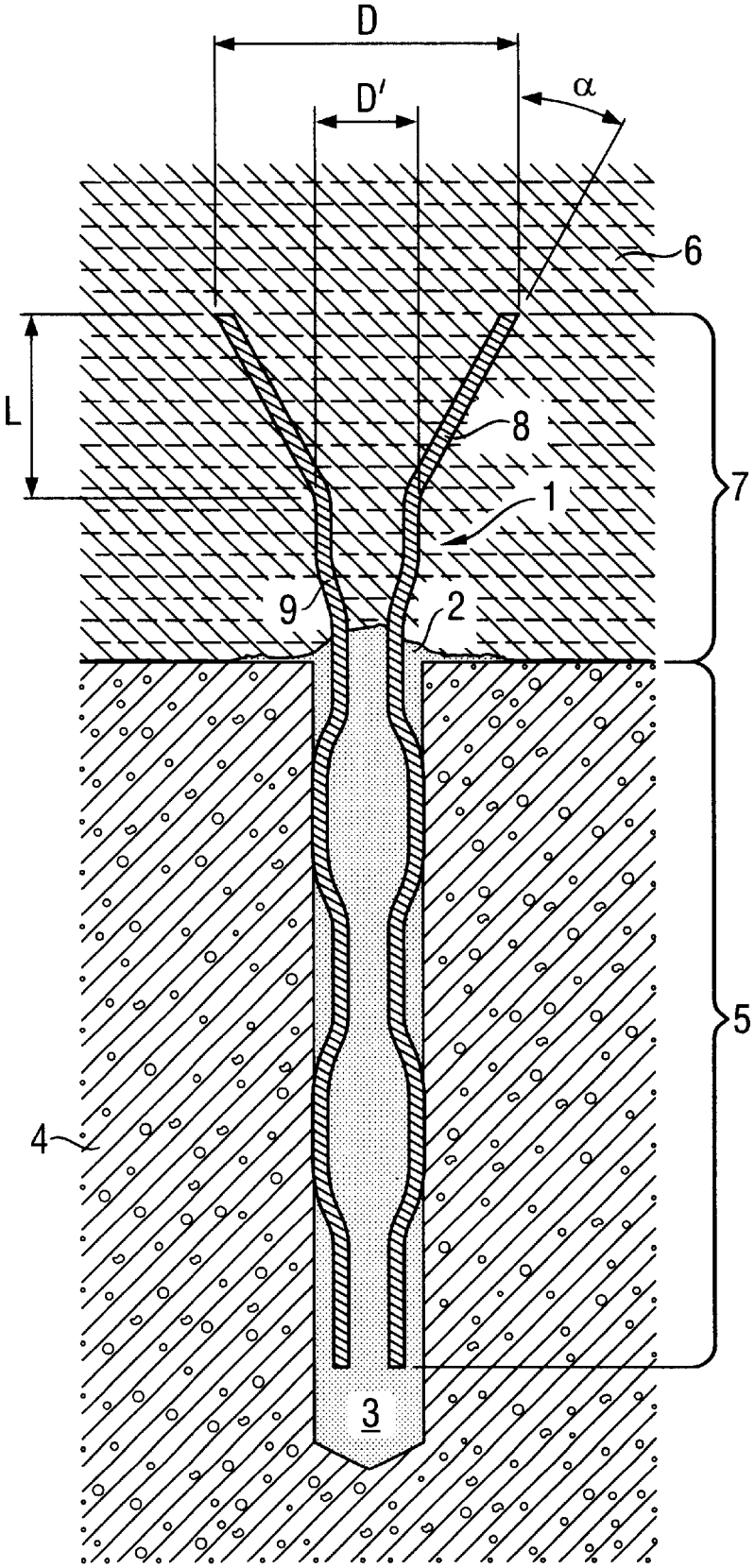
FIG. 1 is an axially extending sectional view of a concrete anchor bolt formed as a unit.

According to FIG. 1, an anchor bolt 1 is characterized by a first axially extending section 5, fixable using a temporarily fluid, settable fixing agent 2 comprised of a reaction resin mortar, and is fixable in a tapped blind borehole 3 in a first solid body 4, comprised of set concrete, and an axially extending projecting second element 7, embeddable in a subsequently setting second solid body 6, comprised of fresh concrete, and an axially extending conically shaped hollow section 8 of the anchor bolt having an essentially uniform wall thickness, with an axial half-angle $\alpha$ of 30° that is the angle between the axis of the anchor bolt 1 and the outer surface of the conically shaped section 8. The conical shaped section 8 is located within the second solid body 6. The radial angle of the conically shaped section 8 is determined as the relationship of the diameter D, D' over the axial length L of the conical shaped section 8 and is approximately 3.5. The conical shaped section 8 is arranged as a radially expandable end of a tubular section with alternating protuberances 9 in one piece with the residual anchor bolt 1.

Figure 2:
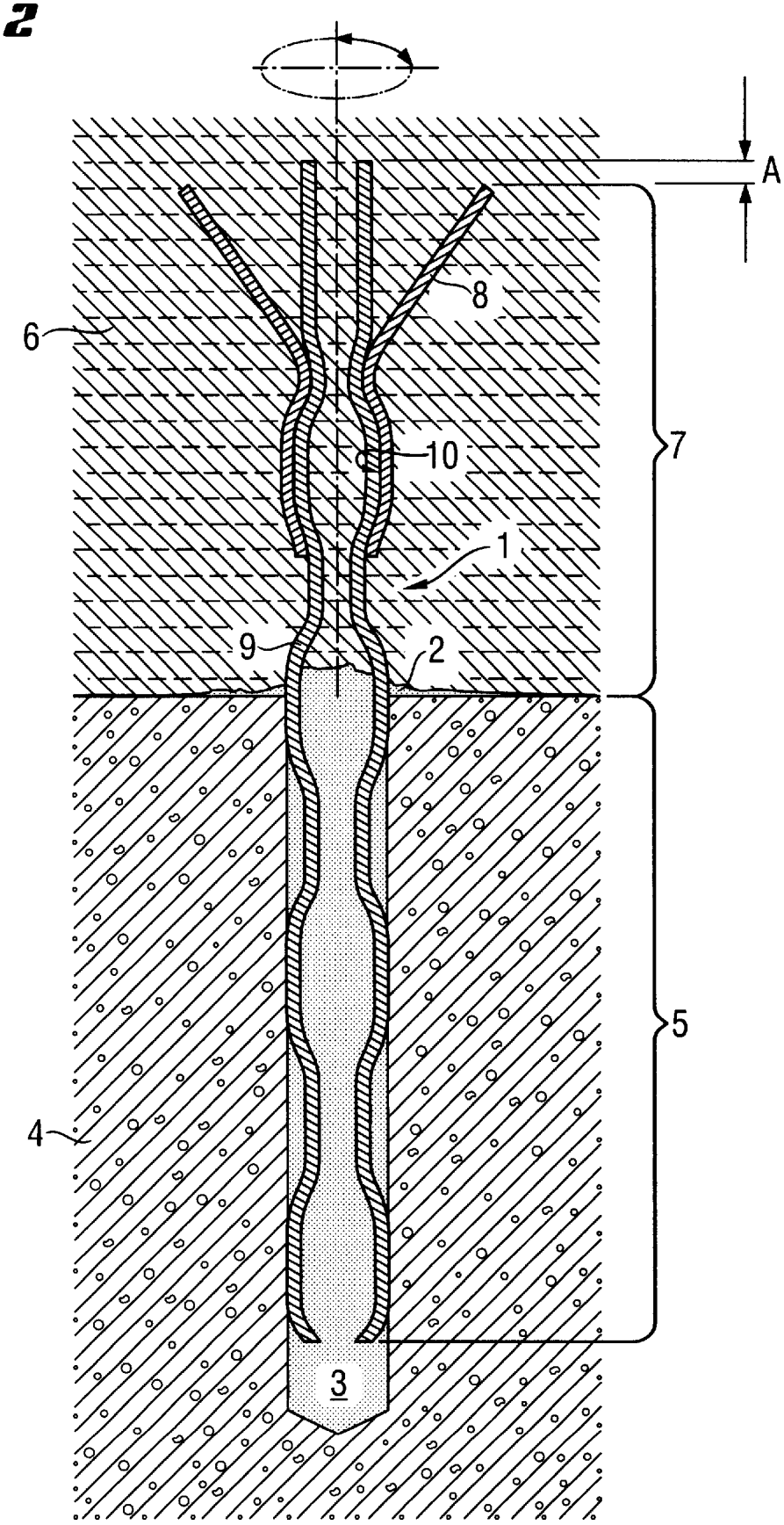
FIG. 2 is an axially extending sectional view of a concrete anchor bolt with a combination conical sleeve.

According to FIG. 2, the conically shaped section 8 is formed as a separate component part and is connected by rotary engagement with a special snap-on axial opening 10 adjacent the end of the anchor bolt 1 within the section 7 formed as a tubular section with alternating protuberances 9, for axial form-locking attachment and guidance, wherein at the time of connection the end of the anchor bolt 1 extends axially outwardly from the end surface of the conically shaped section 8, by a distance A.

What is claimed is:

1. A concrete anchor bolt forming a concrete-to-concrete-bond, comprising a first solid body (4), an axially extending blind borehole (3) in said solid body (4), an elongated axially extending fixing member (1) having a first axially extending section (5) secured in said blind borehole (3) by a temporarily fluid settable fixing agent (2) and a second axially extending section (7) extending radially outwardly from said first solid body (4), said second section (7) to be embedded in a subsequently set second solid body (6), and said second section (7) including an axially extending conically shaped section (8).

2. A concrete anchor bolt, as set forth in claim 1, wherein such conically shaped section (8) forms an angle (a) with the axis of said fixing member (1) is the range of 20° to 40°.

3. A concrete anchor bolt, as set forth in claim 2, wherein said angle (a) of said conically shaped section (8) is 30°.

4. A concrete anchor bolt, as set forth in claim 2, where said conically shaped section (8) has a ratio relationship with a smaller diameter of 2 a larger diameter of 5 and an axial length of 5.

5. A concrete anchor bolt, as set forth in claim 1, wherein said conically shaped section (8) is hollow with an approximately uniform wall thickness.

6. A concrete anchor bolt, as set forth in claim 5, wherein said conically shaped section (8) is formed of one of sheet metal or metal tubing and tube ends of several mm wall thickness.

7. A concrete anchor bolt, as set forth in claim 1, wherein said conically shaped section (8) is formed as a separate part for one of a material bonded connection and an axially extending form locked connection with an axially extending part of said second axially extending section (7).

8. A concrete anchor bolt, as set forth in claim 7, wherein said conically shaped section (8) has an axially extending part extending from a smaller diameter end thereof in form locked connection with an axially extending part of said second axially extending section (7).

9. A concrete anchor bolt, as set forth in claim 1, wherein said conically shaped section (8) is formed as a unit with said second axially extending section (7).

10. A concrete anchor bolt, as set forth in claim 9, wherein said conically shaped section is formed as a radially expanded part of said second axially extending section (7).

* * * * *